US008204429B2

(12) United States Patent
Kawabata

(10) Patent No.: US 8,204,429 B2
(45) Date of Patent: Jun. 19, 2012

(54) IMAGE FORMING APPARATUS CAPABLE OF ELECTROSTATICALLY ATTRACTING SHEET EFFECTIVELY

(75) Inventor: Kenichi Kawabata, Isehara (JP)

(73) Assignee: Ricoh Company, Ltd., Toyko (JP)

( * ) Notice: Subject to any disclaimer, the term of this patent is extended or adjusted under 35 U.S.C. 154(b) by 709 days.

(21) Appl. No.: 12/324,542

(22) Filed: Nov. 26, 2008

(65) Prior Publication Data

US 2009/0136279 A1 May 28, 2009

(30) Foreign Application Priority Data

Nov. 28, 2007 (JP) ..... 2007-306876

(51) Int. Cl.
*G03G 15/00* (2006.01)
*B65H 29/30* (2006.01)

(52) U.S. Cl. ..... 399/401; 399/388; 271/193

(58) Field of Classification Search ..... 399/401; 271/3.18, 3.21, 193; 347/104
See application file for complete search history.

(56) References Cited

U.S. PATENT DOCUMENTS

| | | | | |
|---|---|---|---|---|
| 6,092,800 | A * | 7/2000 | Compera et al. | 271/193 |
| 2006/0127149 | A1* | 6/2006 | Togashi et al. | 399/392 |
| 2006/0132574 | A1 | 6/2006 | Kawabata | |
| 2007/0035083 | A1 | 2/2007 | Kawabata | |
| 2007/0064032 | A1 | 3/2007 | Kawabata | |
| 2007/0103535 | A1* | 5/2007 | Kito | 347/104 |
| 2007/0120936 | A1 | 5/2007 | Kawabata | |

FOREIGN PATENT DOCUMENTS

| | | | |
|---|---|---|---|
| JP | 9-211901 | | 8/1997 |
| JP | 2000-314999 | | 11/2000 |
| JP | 3302823 | | 4/2002 |
| JP | 2004-262557 | | 9/2004 |
| JP | 2005-343167 | | 12/2005 |
| JP | 2007-45596 | | 2/2007 |
| JP | 2007-175979 | | 7/2007 |
| JP | 2008-18644 | | 1/2008 |
| JP | 2008-68955 | | 3/2008 |
| WO | WO 2005108099 | A1 * | 11/2005 |

OTHER PUBLICATIONS

Nov. 15, 2011 Japanese official action in connection with a counterpart Japanese patent application.

* cited by examiner

*Primary Examiner* — Judy Nguyen
*Assistant Examiner* — Justin Olamit
(74) *Attorney, Agent, or Firm* — Cooper & Dunham LLP

(57) ABSTRACT

In an image forming apparatus, a recording head discharges liquid droplets onto a sheet conveyed on a conveying belt to form an image on the sheet. A sheet discharge device is provided downstream from the conveying belt in a sheet conveyance direction and is intermittently driven independently of and in synchronization with the conveying belt to convey the sheet in a sheet discharging direction. A voltage application device applies a voltage to a charger. A distance between the charger and a nip portion formed between a pressing member and the conveying belt for duplex printing is set so that a voltage applied by the voltage application device increases a charged potential of the conveying belt in an area electrostatically attracting a trailing end of a predetermined sheet and a leading end of a subsequent sheet.

8 Claims, 12 Drawing Sheets

IMAGE FORMING APPARATUS CAPABLE OF ELECTROSTATICALLY ATTRACTING SHEET EFFECTIVELY

BACKGROUND

1. Technical Field

The present specification relates to an image forming apparatus, particularly to an image forming apparatus for forming an image on a sheet and including a conveying belt for electrostatically attracting the sheet.

2. Discussion of the Background

Related-art image forming apparatuses, such as copiers, facsimile machines, printers, plotters, or multifunction printers having at least one of copying, printing, scanning, plotting, and facsimile functions, typically form an image on a recording medium (e.g., a sheet). Thus, for example, a recording head moving in a main scanning direction discharges ink droplets onto a sheet being conveyed in a sub-scanning direction to form an image on the sheet.

In one example of such image forming apparatus, a conveying belt is looped over at least two rollers, for example, an upstream roller and a downstream roller, and conveys a sheet. A charging roller is driven by the conveying belt and charges the conveying belt. A pressing member opposes the upstream roller provided upstream in a sheet conveyance direction to press the sheet on the conveying belt against the conveying belt. A recording head discharges ink droplets onto the sheet electrostatically attracted to and conveyed by the conveying belt to form an image on the sheet. A sheet discharge device is provided downstream from the conveying belt in the sheet conveyance direction to discharge the sheet bearing the image to an outside of the image forming apparatus. For duplex printing, a duplex unit reverses and re-feeds the sheet formed with an image on a first side (e.g., a front side) thereof by the recording head so that an image can then be formed on a second side (e.g., a back side) of the sheet.

The conveying belt conveys the sheet intermittently. Thus, it is preferable to drive intermittently also the sheet discharge device, which is provided downstream from the conveying belt in the sheet conveyance direction, in synchronization with the intermittent conveyance of the sheet by the conveying belt.

However, a problem can arise when the sheet discharge device intermittently conveys the sheet at a speed identical to or slower than a speed at which the conveying belt intermittently conveys the sheet, in that slack may arise in the sheet fed from the conveying belt and result in a sheet jam. Alternatively, the sheet may separate from the conveying belt and consequently a faulty image may be formed on the sheet.

To address this possible problem, the sheet discharge device intermittently conveys the sheet at a speed faster than the speed at which the conveying belt intermittently conveys the sheet. However, in so doing, the sheet discharge device may pull the sheet with a force greater than an electrostatic attraction force of the conveying belt when the sheet passes through a nip portion formed between the conveying belt and the pressing member, at which point the sheet is held in place on the conveying belt solely by the electrostatic attraction force of the conveying belt. Consequently, the sheet discharge device and the conveying belt may not intermittently convey the sheet with respect to the recording head properly, resulting in formation of a faulty image or a low-quality image.

Further, in duplex printing, a sheet bearing an image on the front side thereof may warp when liquid droplets forming the image are dried. As a result, the sheet may not be properly attracted to the conveying belt, resulting in formation of a faulty image or a low-quality image on the back side of the sheet.

BRIEF SUMMARY

In an aspect of this disclosure, there is provided a novel image forming apparatus that includes a recording head, a conveying belt, at least two rollers, a pressing member, a charger, a sheet discharge device, a duplex device, and a voltage application device. The recording head is configured to discharge liquid droplets onto a sheet to form an image on the sheet. The conveying belt is configured to electrostatically attract and convey the sheet to face the recording head. The at least two rollers are disposed so as to support the conveying belt. The pressing member opposes one of the at least two rollers provided upstream in a sheet conveyance direction via the conveying belt to press the sheet against the conveying belt. The charger is rotatably driven by the conveying belt to charge the conveying belt. The sheet discharge device is provided downstream from the conveying belt in the sheet conveyance direction to convey the sheet in a sheet discharging direction, and is intermittently driven independently of and in synchronization with the conveying belt. The duplex device is configured to reverse and re-feed the sheet bearing the image formed on a first side thereof by the recording head to form an image on a second side of the sheet. The voltage application device is configured to apply a voltage to the charger. A distance between the charger and a nip portion formed between the pressing member and the conveying belt for duplex printing is set so that a voltage applied by the voltage application device increases a charged potential of the conveying belt in an area electrostatically attracting a trailing end of a predetermined sheet on which an image is to be formed on a first side thereof and a leading end of a subsequent sheet on which an image is to be formed on a second side thereof In another aspect of this disclosure, there is provided a novel image forming apparatus that includes a recording head, a conveying belt, at least two rollers, a pressing member, a charger, a sheet discharge device, a duplex device, and a voltage application device. The recording head is configured to discharge liquid droplets onto a sheet to form an image on the sheet. The conveying belt is configured to electrostatically attract and convey the sheet to face the recording head. The at least two rollers are disposed so as to support the conveying belt. The pressing member opposes one of the at least two rollers provided upstream in a sheet conveyance direction via the conveying belt to press the sheet against the conveying belt. The charger is rotatably driven by the conveying belt to charge the conveying belt. The sheet discharge device is provided downstream from the conveying belt in the sheet conveyance direction to convey the sheet in a sheet discharging direction, and is intermittently driven independently of and in synchronization with the conveying belt. The duplex device is configured to reverse and re-feed the sheet bearing the image formed on a first side thereof by the recording head to form an image on a second side of the sheet. The voltage application device is configured to apply an alternating voltage to the charger. A distance between the charger and a nip portion formed between the pressing member and the conveying belt for duplex printing is set so that an alternating voltage applied by the voltage application device lengthens a charge cycle of the conveying belt in an area electrostatically attracting a trailing end of a predetermined sheet on which an image is to be formed on a first side thereof and a leading end of a subsequent sheet on which an image is to be formed on a second side thereof.

BRIEF DESCRIPTION OF THE DRAWINGS

The aforementioned and other aspects, features and advantages would be better understood by reference to the following detailed description when considered in connection with the accompanying drawings, wherein.

DETAILED DESCRIPTION OF THE EXEMPLARY EMBODIMENTS

Figure 1:
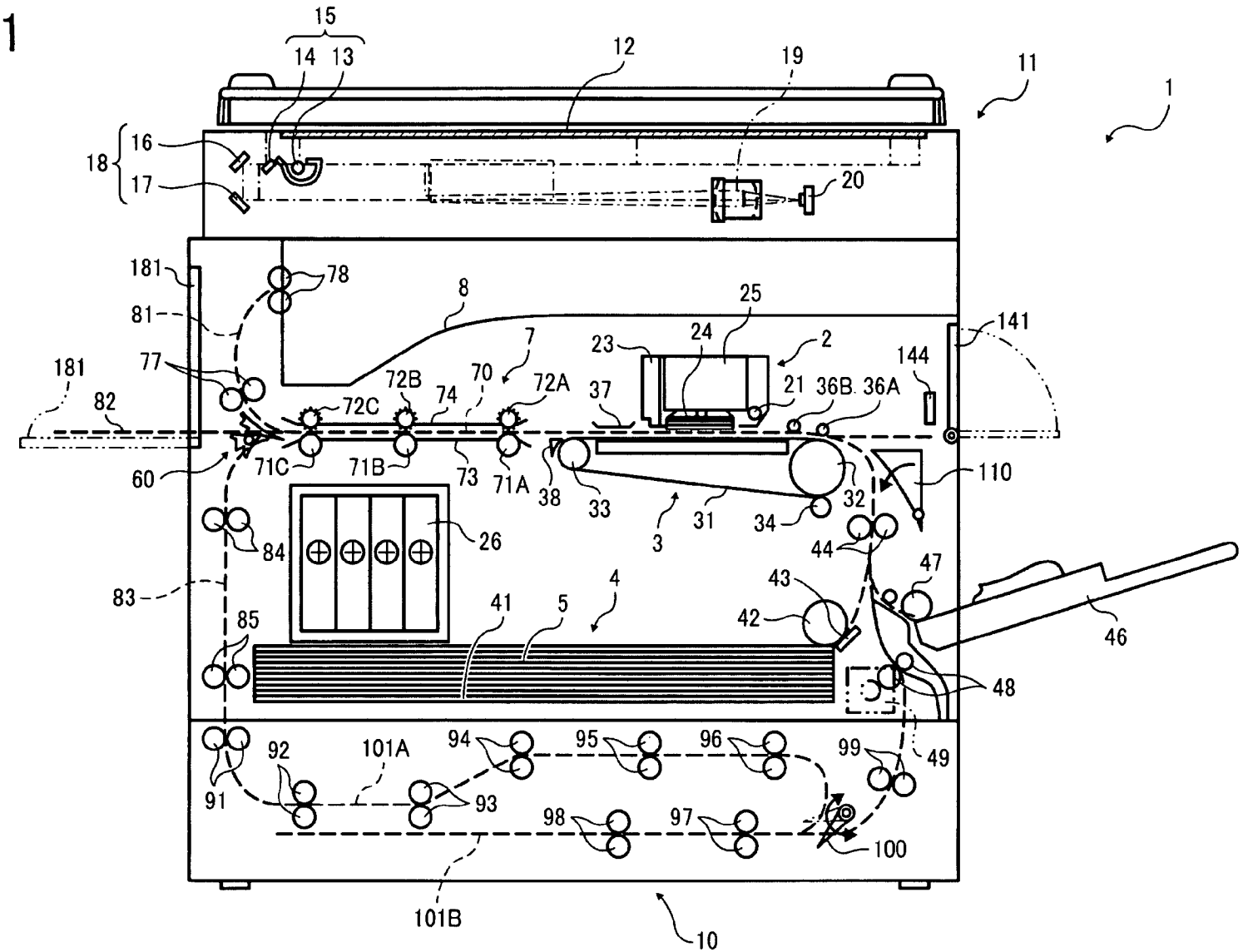
FIG. 1 is a schematic view of an image forming apparatus according to an exemplary embodiment.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIGS. 1 to 4, an overview of an example of an image forming apparatus 1 according to an exemplary embodiment is described. FIG. 1 is a schematic view of the image forming apparatus 1.

As illustrated in FIG. 1, the image forming apparatus 1 includes an image forming device 2, a sub-scanning conveyance device 3, a sheet supply device 4, a sheet discharge device 7, a duplex unit 10, and an image scanner 11.

The image forming device 2 includes a guide rod 21, a carriage 23, recording heads 24, and sub tanks 25.

The sub-scanning conveyance device 3 includes a conveying belt 31, a conveying roller 32, a driven roller 33, a charging roller 34, pressing rollers 36A and 36B, a guide plate 37, and a separating claw 38.

The sheet supply device 4 includes a paper tray 41, a sheet feeding roller 42, a friction pad 43, a registration roller pair 44, a bypass tray 46, a bypass tray roller 47, a vertically conveying roller pair 48, and a sheet feeding motor 49.

The sheet discharge device 7 includes a conveying path 70, conveying rollers 71A, 71B, and 71C (hereinafter referred to as the conveying rollers 71, when distinction therebetween is unnecessary), spurs 72A, 72B, and 72C (hereinafter referred to as the spurs 72, when distinction therebetween is unnecessary), a lower guide portion 73, an upper guide portion 74, a reverse roller pair 77, and a reverse-discharge roller pair 78.

The duplex unit 10 includes duplex conveying roller pairs 91, 92, 93, 94, 95, and 96, reverse roller pairs 97 and 98, an exit roller pair 99, a separating plate 100, a standby conveying path 101A, and a switchback conveying path 101B.

The image scanner 11 includes an exposure glass 12, scanning optical systems 15 and 18, a lens 19, and an image scanning device 20. The scanning optical system 15 includes a light source 13 and a mirror 14. The scanning optical system 18 includes mirrors 16 and 17.

The image forming apparatus 1 further includes an output tray 8, ink cartridges 26, a separation mechanism 60, a first conveying path 81, a second conveying path 82, a third conveying path 83, duplex relay roller pairs 84 and 85, a switching guide plate 110, a single sheet bypass tray 141, and a straight output tray 181.

In the image forming apparatus 1, the image forming device 2 forms an image on a sheet 5 being conveyed by the sub-scanning conveyance device 3. The sheet supply device 4 provided in a lower portion of the image forming apparatus 1 feeds sheets 5 one by one from the paper tray 41. The sub-scanning conveyance device 3 conveys the individual sheet 5 at a position facing the image forming device 2. The image forming device 2 discharges liquid droplets onto the sheet 5 being thus conveyed to form (e.g., record) an image on the sheet 5. In simplex printing (e.g., single-sided printing), the sheet 5 is conveyed through the sheet discharge device 7 and discharged onto the output tray 8 provided in an upper portion of the image forming apparatus 1. In duplex printing (e.g., double-sided printing), the sheet 5 is conveyed to the sheet discharge device 7 and to the duplex unit 10, serving as a duplex device, provided in a lower portion of the image forming apparatus 1. Switchback conveyance of the sheet 5 is performed to re-feed the sheet 5 to the sub-scanning conveyance device 3. Thereby, the sheet 5 is formed with images on both sides thereof and discharged onto the output tray 8.

Further, in an upper portion of the image forming apparatus 1 above the output tray 8, the image scanner 11 (e.g., a scanner) for scanning an image is provided as a system for inputting image data (e.g., print data) for an image to be formed by the image forming device 2. In the image scanner 11, the scanning optical systems 15 and 18 move to scan an image on an original document sheet placed on the exposure glass 12. The scanned image of the original document sheet is captured as an image signal by the image scanning device 20 provided rearward of the lens 19 (e.g., on the right side of the lens 19 in FIG. 1). The captured image signal is digitized and subjected to image processing. Thereby, the image-processed print data can be printed.

Figure 2:
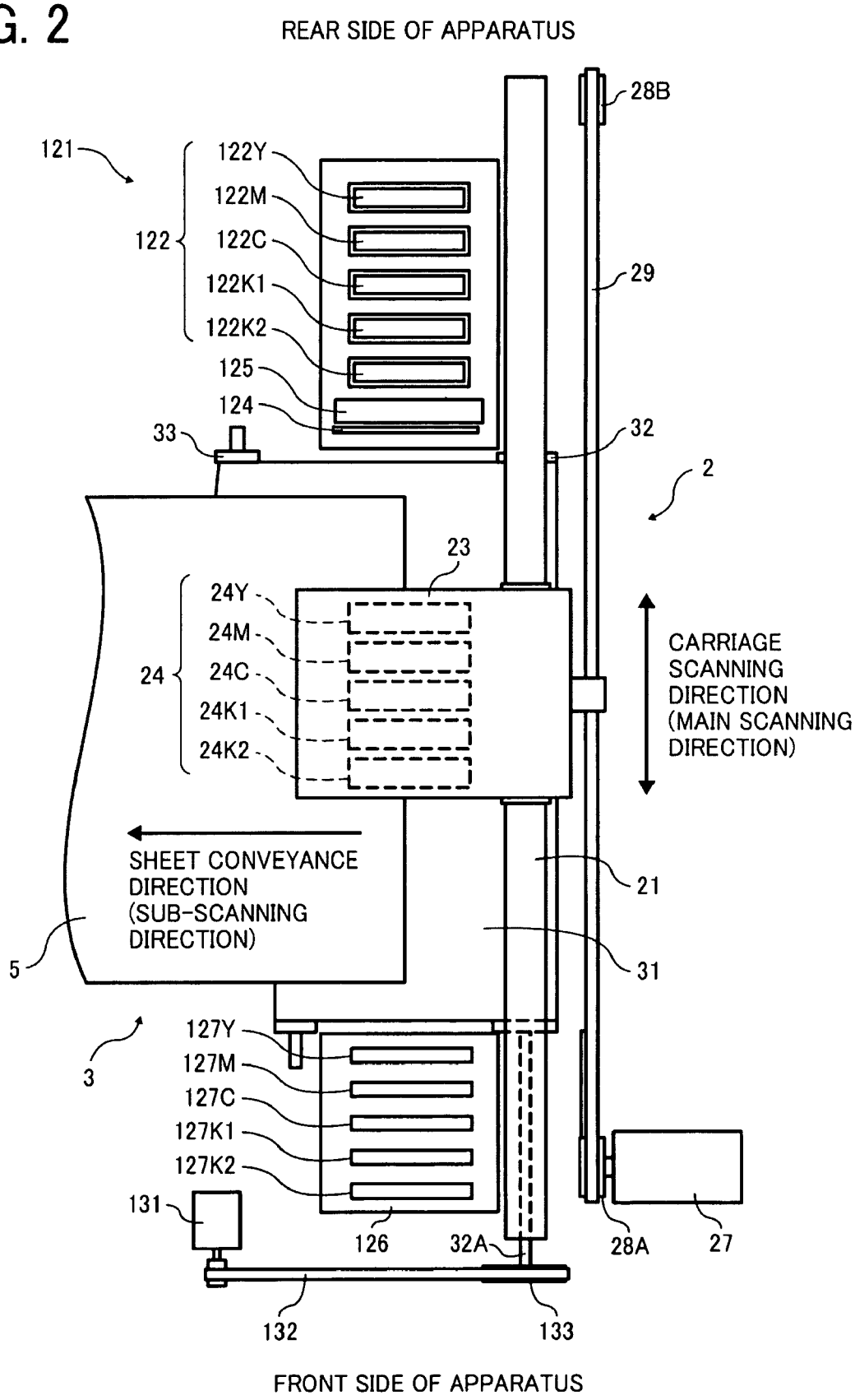
FIG. 2 is a plan view of an image forming device and a sub-scanning conveyance device included in the image forming apparatus shown in FIG. 1.

FIG. 2 is a plan view of the image forming device 2 and the sub-scanning conveyance device 3. As illustrated in FIG. 2, the image forming device 2 further includes a main scanning motor 27, a drive pulley 28A, a driven pulley 28B, a timing belt 29, a maintenance-restoration device 121, and a preliminarily discharged droplet receiver 126. The recording heads 24 include recording heads 24Y, 24M, 24C, 24K1, and 24K2. The maintenance-restoration device 121 includes moisture retaining caps 122, a wiper blade 124, and a preliminarily discharged droplet receiver 125. The moisture retaining caps 122 include moisture retaining caps 122K2, 122K1, 122C, 122M, and 122Y. The preliminarily discharged droplet receiver 126 includes openings 127K2, 127K1, 127C, 127M, and 127Y. The sub-scanning conveyance device 3 further includes a sub-scanning motor 131, a timing belt 132, and a timing roller 133. The conveying roller 32 includes a shaft 32A.

Using the guide rod 21 and a guide rail, the image forming device 2 holds the carriage 23 in a cantilever manner such that the carriage 23 can move in a main scanning direction. Further, using the main scanning motor 27, the image forming device 2 moves the carriage 23 for scanning in the main scanning direction via the timing belt 29 looped over the drive pulley 28A and the driven pulley 28B.

The carriage 23 is mounted with the recording heads 24, which are liquid droplet discharging heads that discharge liquid droplets of respective colors. According to this exemplary embodiment, each of the recording heads 24 is a shuttle-type recording head which serves as an image forming member configured to discharge the liquid droplets for image formation, while the carriage 23 is moved in the main scanning direction and the sheet 5 is conveyed in a sheet conveyance direction (e.g., a sub-scanning direction) by the sub-scanning conveyance device 3. Alternatively, a line-type recording head can also be employed.

The recording heads 24 include the two recording heads 24K1 and 24K2 configured to discharge black ink, and the recording heads 24C, 24M, and 24Y configured to discharge cyan ink, magenta ink, and yellow ink, respectively. That is, the recording heads 24 include five recording heads (e.g., liquid discharging heads) in total (hereinafter referred to as the recording heads 24, when distinction therebetween is unnecessary). The inks of the respective colors are supplied from the respective sub tanks 25 depicted in FIG. 1 installed in the carriage 23.

Meanwhile, as illustrated in FIG. 1, the ink cartridges 26 for the respective colors can be detachably attached to a cartridge attachment section provided to a front side of the image forming apparatus 1. The ink cartridges 26 are recording liquid cartridges which store the black ink, the cyan ink, the magenta ink, and the yellow ink, respectively, and supply the respective inks to the sub tanks 25 for the respective colors. According to this exemplary embodiment, the black ink is supplied from one of the ink cartridges 26 to two of the sub tanks 25.

The recording heads 24 may be so-called piezo, thermal, or electrostatic recording heads, for example. A piezo recording head includes a piezoelectric element as a pressure generating device (e.g., an actuator device) which applies pressure to ink in an ink channel (e.g., a pressure generating chamber). Using the piezoelectric element, the piezo recording head deforms a diaphragm forming a wall surface of the ink channel to change an internal volume of the ink channel and discharge ink droplets. A thermal recording head uses a heat generating resistor to heat and bubble ink in an ink channel. Then, using resultant pressure, the thermal recording head discharges ink droplets. In an electrostatic recording head, an electrode is disposed to face a diaphragm forming a wall surface of an ink channel. Then, using an electrostatic force generated between the electrode and the diaphragm, the electrostatic recording head deforms the diaphragm to change an internal volume of the ink channel and discharge ink droplets.

Further, as illustrated in FIG. 2, the maintenance-restoration device 121 is provided in a non-printing area on one side in the scanning direction of the carriage 23 to maintain and restore a state of a nozzle of each of the recording heads 24. The maintenance-restoration device 121 includes the five moisture retaining caps 122K2, 122K1, 122C, 122M, and 122Y (hereinafter referred to as the moisture retaining caps 122, when distinction therebetween is unnecessary), which cap respective nozzle surfaces of the five recording heads 24K2, 24K1, 24C, 24M, and 24Y. The moisture retaining cap 122K2 serves not only as a moisture retaining cap but also as a suction cap. The maintenance-restoration device 121 further includes, for example, the wiper blade 124 which wipes the nozzle surfaces of the recording heads 24, and the preliminarily discharged droplet receiver 125 which receives liquid droplets discharged in a preliminary discharge not contributing to recording (e.g., image formation).

Further, as illustrated in FIG. 2, the preliminarily discharged droplet receiver 126 is provided in a non-printing area on the other side in the scanning direction of the carriage 23 to receive liquid droplets discharged from the five recording heads 24 in a preliminary discharge not contributing to recording (i.e., image formation). The preliminarily discharged droplet receiver 126 includes five openings 127K2, 127K1, 127C, 127M, and 127Y (hereinafter referred to as the openings 127, when distinction therebetween is unnecessary), which correspond to the recording heads 24K2, 24K1, 24C, 24M, and 24Y, respectively.

Figure 3:
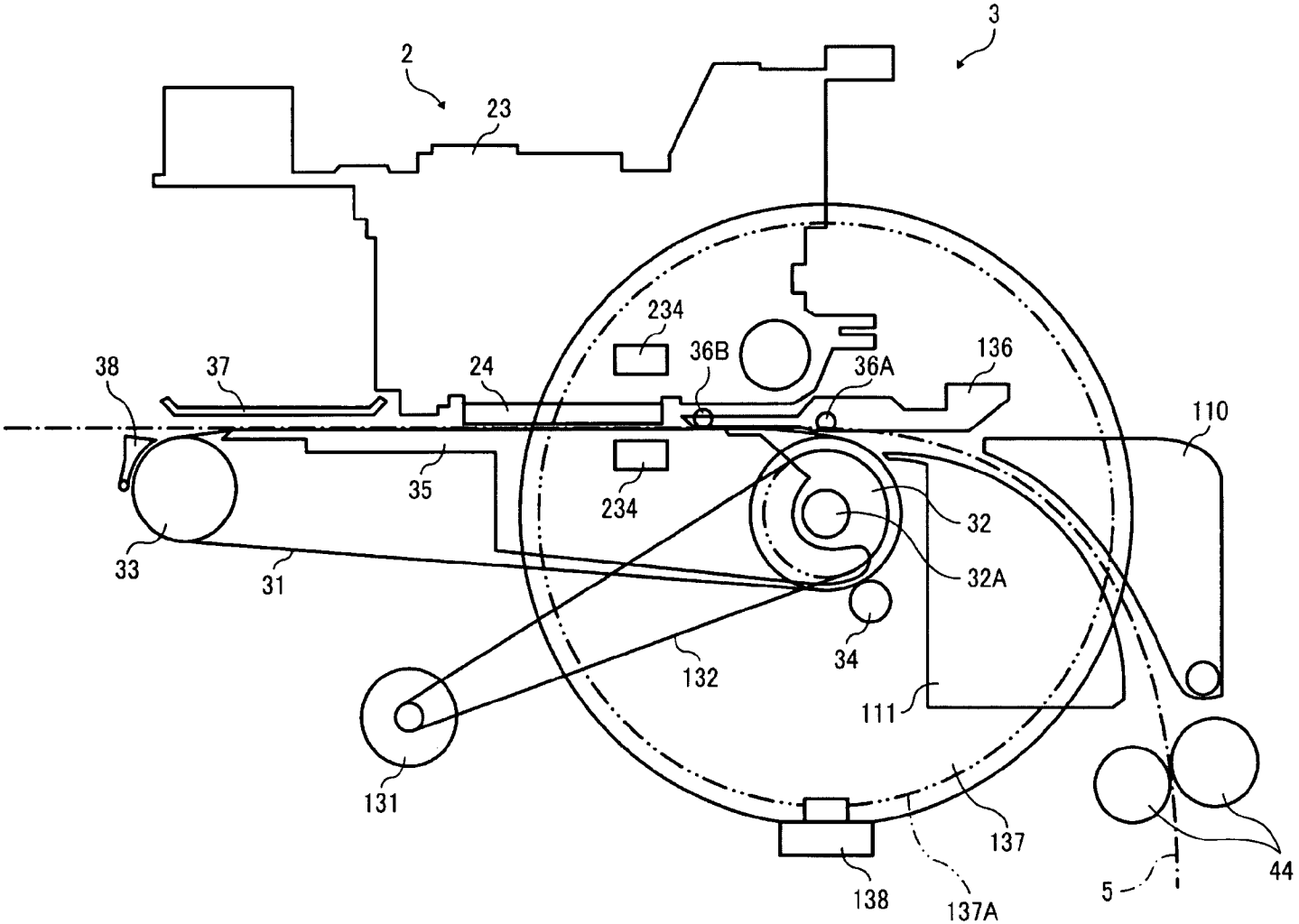
FIG. 3 is a front view of the sub-scanning conveyance device shown in FIG. 2.

FIG. 3 is a front view of the sub-scanning conveyance device 3 partially illustrated in a transparent manner. As illustrated in FIG. 3, the sub-scanning conveyance device 3 further includes a platen guide member 35, a temperature-humidity sensor 234, a holding member 136, an encoder wheel 137, and an encoder sensor 138. The encoder wheel 137 includes a slit 137A.

In the sub-scanning conveyance device 3, the conveying roller 32 serves as a drive roller for conveying the sheet 5 fed from below the sub-scanning conveyance device 3 to the image forming device 2 by changing the conveyance direction of the sheet 5 by approximately 90 degrees to make the sheet 5 face the image forming device 2. The loop-shaped endless conveying belt 31 is looped over the conveying roller 32 and the driven roller 33 serving as a tension roller. The charging roller 34 serves as a charger applied with an alternating high voltage by a high voltage power supply to charge a surface of the conveying belt 31. The platen guide member 35 guides the conveying belt 31 in an area facing the image forming device 2. The pressing roller 36A, serving as a pressing member, is rotatably held by the holding member 136 to press the sheet 5 against the conveying belt 31 at a position opposing the conveying roller 32. Meanwhile, the downstream pressing roller 36B presses the sheet 5 against the conveying belt 31 in front of the recording heads 24. The guide plate 37 presses an upper surface of the sheet 5 bearing an image formed by the image forming device 2. The separating claw 38 separates the sheet 5 bearing the image from the conveying belt 31.

The conveying belt 31 of the sub-scanning conveyance device 3 is configured to rotate in the sheet conveyance direction (e.g., the sub-scanning direction) illustrated in FIG. 2 as the conveying roller 32 is rotated via the timing belt 132 and the timing roller 133 (depicted in FIG. 2) by the sub-scanning motor 131 including a DC (direct current) brushless motor. The conveying belt 31 according to this exemplary embodiment has a two-layer structure including a surface layer and a back layer (e.g., a middle resistance layer or an earth layer), for example. The surface layer serves as a sheet attracting surface including a pure resin material not subjected to resistance control, e.g., an ETFE (ethylene tetrafluoroethylene) pure material. The back layer includes a material identical with the material included in the surface layer but is subjected to the resistance control using carbon. The structure of the conveying belt 31, however, is not limited to the above-described structure, and thus may be a single-layer structure or a multilayer structure including three or more layers.

The sub-scanning conveyance device 3 includes, between the driven roller 33 and the charging roller 34, a cleaning device for removing paper powder and so forth adhered to the surface of the conveying belt 31, and a diselectrification brush for removing charge from the surface of the conveying belt 31. According to this exemplary embodiment, Mylar (registered trademark) is used to form the cleaning device.

The shaft 32A of the conveying roller 32 is provided with the high-resolution encoder wheel 137 including the slit 137A. To detect the slit 137A, the encoder sensor 138 formed by a transmissive photosensor is provided. The encoder wheel 137 and the encoder sensor 138 constitute a rotary encoder described later.

As illustrated in FIG. 1, in the sheet supply device 4, the paper tray 41 is configured to be insertable into and removable from the front side of the image forming apparatus 1, and to store a multitude of sheets 5 stacked in layers. The sheet feeding roller 42 and the friction pad 43 send out the sheets 5 stored in the paper tray 41 by separating the sheets 5 from one another. The registration roller pair 44 registers the fed sheet 5.

Further, in the sheet supply device 4, the bypass tray 46 stores a multitude of sheets 5 stacked in layers. The bypass tray roller 47 feeds the sheets 5 one by one from the bypass tray 46. The vertically conveying roller pair 48 conveys a sheet 5 fed from a paper tray optionally attached to a lower portion of the image forming apparatus 1 or from the duplex unit 10 described later. The sheet feeding motor 49 formed by a HB (hybrid) type stepping motor and serving as a drive device drives to rotate, via an electromagnetic clutch, members for feeding and conveying the sheet 5 to the sub-scanning conveyance device 3, such as the sheet feeding roller 42, the registration roller pair 44, the bypass tray roller 47, and the vertically conveying roller pair 48.

In the sheet discharge device 7, the conveying path 70 serves as a conveying path through which the sheet 5 is conveyed between the lower guide portion 73 and the upper guide portion 74. The three conveying rollers 71 and the opposing spurs 72 convey the sheet 5 separated by the separating claw 38 of the sub-scanning conveyance device 3. The lower guide portion 73 and the upper guide portion 74 guide the sheet 5 conveyed between the conveying rollers 71 and the spurs 72. The reverse roller pair 77 and the reverse-discharge roller pair 78 receive the sheet 5 sent out from between the lower guide portion 73 and the upper guide portion 74, reverse the sheet 5 through the first conveying path 81 (e.g., a sheet reverse-discharge path), and discharge the sheet 5 onto the output tray 8 with the sheet 5 face down.

On an exit side of the conveying path 70, the separation mechanism 60 is provided to switch among the first conveying path 81, the second conveying path 82, and the third conveying path 83. The first conveying path 81 reverses and discharges the sheet 5 onto the output tray 8. The second conveying path 82 discharges the sheet 5 onto the straight output tray 181 described later. The third conveying path 83 conveys the sheet 5 to the duplex unit 10. Further, the duplex relay roller pairs 84 and 85 are provided along the third conveying path 83 to convey to the duplex unit 10 the sheet 5 formed with an image on a first side thereof.

In the duplex unit 10, the standby conveying path 101A and the switchback conveying path 101B receive the sheet 5 conveyed into the duplex unit 10. The standby conveying path 101A is provided with the duplex conveying roller pairs 91 to 96 disposed in order of closeness to an entrance of the standby conveying path 101A. Meanwhile, the switchback conveying path 101B is provided with the reverse roller pairs 97 and 98. Further, the duplex exit roller pair 99 is provided to send the sheet 5 from the switchback conveying path 101B to the vertically conveying roller pair 48 to print an image on a second side of the sheet 5. Further, the separating plate 100 is swingably provided to switch between a conveying path for conveying the sheet 5 from the standby conveying path 101A to the switchback conveying path 101B and a conveying path for re-feeding the sheet 5 from the switchback conveying path 101B to the vertically conveying roller pair 48. The separating plate 100 is swingable between a switchback position indicated by a solid line and a sheet re-feeding position indicated by a broken line in FIG. 1.

The sheet 5 sent from the duplex unit 10 is conveyed to the above-described vertically conveying roller pair 48 and then to the registration roller pair 44.

As illustrated in FIGS. 1 and 3, the switching guide plate 110 is swingably provided to form a slack in the sheet 5 between the registration roller pair 44 and a nip portion formed between the conveying roller 32 and the pressing roller 36A via the conveying belt 31 of the sub-scanning conveyance device 3 and prevent back tension from being applied to the sheet 5 when the registration roller pair 44 conveys the sheet 5 fed from the paper tray 41 of the sheet supply device 4, the bypass tray 46, or the duplex unit 10 described above.

To send the sheet 5 from the registration roller pair 44 to the sub-scanning conveyance device 3, the switching guide plate 110 at a position illustrated in FIG. 1 swings in a direction indicated by an arrow in FIG. 1 to guide the sheet 5. When the sheet 5 reaches the sub-scanning conveyance device 3, the switching guide plate 110 returns to the position illustrated in FIG. 1 to be able to form the slack.

As illustrated in FIG. 1, to enable a manual feeding operation of a single sheet in the image forming apparatus 1 according to this exemplary embodiment, the single sheet bypass tray 141 is provided to one side of the image forming apparatus 1 to be openable (e.g., to be folded open) and closable with respect to the image forming apparatus 1. To perform a single sheet manual feeding operation, the single sheet bypass tray 141 is folded open to a position indicated by a broken line in FIG. 1. A sheet 5 manually fed from the single sheet bypass tray 141 can be linearly inserted straight into a space between the conveying roller 32 and the pressing roller 36A of the sub-scanning conveyance device 3, while being guided by an upper surface of the switching guide plate 110.

Meanwhile, to discharge the sheet 5 bearing the image straight face up, the straight output tray 181 is provided to the other side of the image forming apparatus 1 to be openable (e.g., to be folded open) and closable with respect to the image forming apparatus 1. With the straight output tray 181 folded open, the second conveying path 82 (e.g., a straight output path) is formed through which the sheet 5 sent out from between the lower guide portion 73 and the upper guide portion 74 of the sheet discharge device 7 is linearly discharged onto the straight output tray 181.

With the above-described configuration, if a sheet difficult to convey in a curved state, such as an OHP (overhead projector) transparency and thick paper, for example, is used as the sheet 5, the single sheet manual feeding operation can be performed to feed the sheet 5 from the single sheet bypass tray 141 and linearly convey the sheet 5 to the straight output tray 181. It is needless to say that a normal sheet, such as plain paper, can also be fed from the single sheet bypass tray 141 and linearly discharged onto the straight output tray 181.

Figure 4:
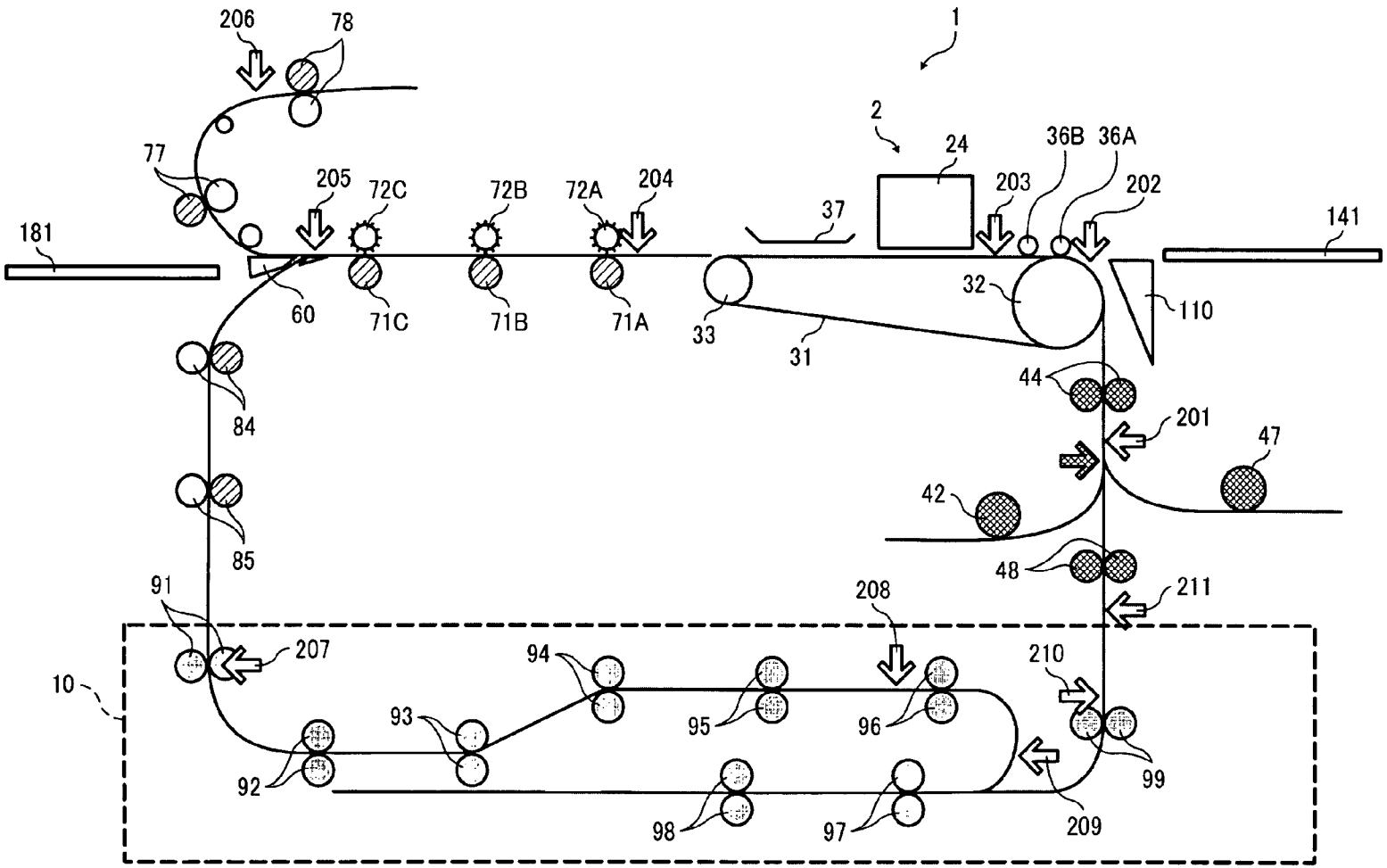
FIG. 4 is a partially sectional view of the image forming apparatus shown in FIG. 1.

With reference to FIG. 4, the following describes a variety of sensors provided in the image forming apparatus 1. FIG. 4 is a partially sectional view of the image forming apparatus 1. The image forming apparatus 1 further includes a conveyance-registration sensor 201, an image forming device entrance sensor 202, an image registration sensor 203, an image forming device exit sensor 204, a separation sensor 205, an output sensor 206, a duplex entrance vertical conveyance sensor 207, a standby sensor 208, a reversal sensor 209, a duplex exit vertical conveyance sensor 210, and an electromagnetic clutch open sensor 211.

To detect the sheet 5, the conveyance-registration sensor 201 is provided upstream from the registration roller pair 44 in the sheet conveyance direction, and the image forming device entrance sensor 202 is provided upstream from the nip portion formed between the conveying roller 32 and the pressing roller 36A via the conveying belt 31. Further, to register an image writing position, the image registration sensor 203 is provided downstream from the pressing roller 36B in the sheet conveyance direction (e.g., at an entrance of the image forming device 2). Further, the image forming device exit sensor 204 is provided upstream from the conveying roller 71A in the sheet conveyance direction (e.g., at an exit of the image forming device 2), and the separation sensor 205 is provided downstream from the conveying roller 71C in the sheet conveyance direction (e.g., at an exit of the sheet discharge device 7 depicted in FIG. 1). Further, the output sensor 206 is provided upstream from the reverse-discharge roller pair 78 in the sheet conveyance direction, and the duplex entrance vertical conveyance sensor 207 is provided near the duplex conveying roller pair 91 of the duplex unit 10. Further, the standby sensor 208 is provided upstream from the conveying roller pair 96 in the sheet conveyance direction, and the reversal sensor 209 is provided near the separating plate 100 depicted in FIG. 1. Further, the duplex exit vertical conveyance sensor 210 is provided downstream from the duplex exit roller pair 99 in the sheet conveyance direction, and the electromagnetic clutch open sensor 211 is provided upstream from the vertically conveying roller pair 48 in the sheet conveyance direction.

Figure 5:
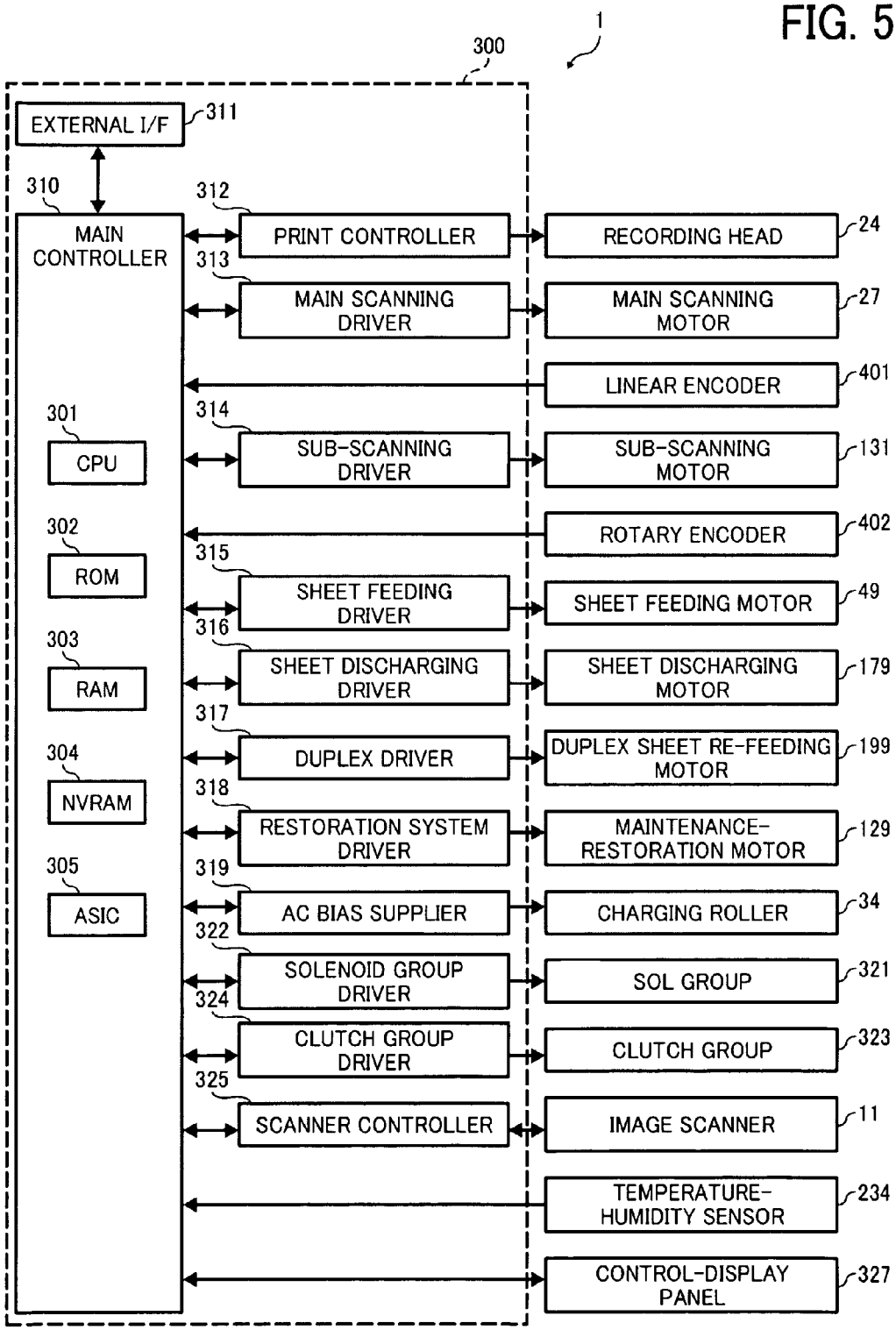
FIG. 5 is a block diagram of a controller included in the image forming apparatus shown in FIG. 1.

With reference to a block diagram of FIG. 5, description is now made of an overview of a controller of the image forming apparatus 1. The image forming apparatus 1 further includes a controller 300, a sheet discharging motor 179, a duplex sheet re-feeding motor 199, a maintenance-restoration motor 129, a solenoid (SOL) group 321, a clutch group 323, a control-display panel 327, a linear encoder 401, and a rotary encoder 402. The controller 300 includes a main controller 310, an external I/F (interface) 311, a print controller 312, a main scanning driver 313, a sub-scanning driver 314, a sheet feeding driver 315, a sheet discharging driver 316, a duplex driver 317, a restoration system driver 318, an AC (alternating current) bias supplier 319, a solenoid group driver 322, a clutch group driver 324, and a scanner controller 325. The main controller 310 includes a CPU (central processing unit) 301, a ROM (read-only memory) 302, a RAM (random access memory) 303, an NVRAM (non-volatile random access memory) 304, and an ASIC (application specific integrated circuit) 305.

The main controller 310 serves as a control device for controlling the entire image forming apparatus 1. The ROM 302 stores programs executed by the CPU 301 and other fixed data. The RAM 303 temporarily stores image data and so forth. The NVRAM 304 is a non-volatile memory for storing data even when the image forming apparatus 1 is powered off. The ASIC 305 performs a variety of signal processing on the image data, image processing including sorting and so forth, and other processing of input and output signals for controlling the entire image forming apparatus 1.

The external I/F 311 is interposed between a host system and the main controller 310 to transmit and receive data and signals therebetween. The print controller 312 includes a head driver for performing drive control of the recording heads 24. The main scanning driver 313 serves as a motor driver for driving the main scanning motor 27 which moves the carriage 23 depicted in FIG. 2 for scanning. The sub-scanning driver 314 drives the sub-scanning motor 131. The sheet feeding driver 315 drives the sheet feeding motor 49. The sheet discharging driver 316 drives the sheet discharging motor 179 which drives the respective rollers of the sheet discharge device 7 depicted in FIG. 1. The duplex driver 317 drives the duplex sheet re-feeding motor 199 which drives the respective rollers of the duplex unit 10 depicted in FIG. 1. The restoration system driver 318 drives the maintenance-restoration motor 129 which drives the maintenance-restoration device 121 depicted in FIG. 2. The AC bias supplier 319, serving as a voltage application device, supplies an AC bias voltage to the charging roller 34.

The solenoid group driver 322 serves as a driver for driving the solenoid (SOL) group 321 including a variety of solenoids. The clutch group driver 324 drives the clutch group 323 including, for example, an electromagnetic clutch for the sheet feeding operation. The scanner controller 325 controls the image scanner 11.

The main controller 310 receives input of a detection signal transmitted from the temperature-humidity sensor 234 which detects a temperature and a humidity (i.e., environmental conditions) around the conveying belt 31 depicted in FIG. 4. The main controller 310 also receives input of detection signals transmitted from the variety of sensors as described above in FIG. 4. The main controller 310 further receives key inputs from the control-display panel 327 which includes a variety of display devices and a variety of keys such as numeric keys and a print start key provided on the image forming apparatus 1. The main controller 310 also outputs display information to the control-display panel 327.

The main controller 310 further receives input of a signal (e.g., a detection pulse) output from the linear encoder 401. The linear encoder 401 includes an encoder scale disposed in the main scanning direction to detect a travel distance of the carriage 23, and a photosensor (e.g., an encoder sensor) which detects a slit formed in the encoder scale. Based on the output signal, the main controller 310 performs drive control of the main scanning motor 27 via the main scanning driver 313 to move the carriage 23 by a predetermined distance in a predetermined direction.

The main controller 310 further receives input of a signal (e.g., a pulse) output from the rotary encoder 402 including the encoder wheel 137 and the encoder sensor 138 formed by a photosensor depicted in FIG. 3. Based on the output signal, the main controller 310 performs drive control of the sub-scanning motor 131 via the sub-scanning driver 314 to move the conveying belt 31 via the conveying roller 32 depicted in FIG. 2.

Figure 6:
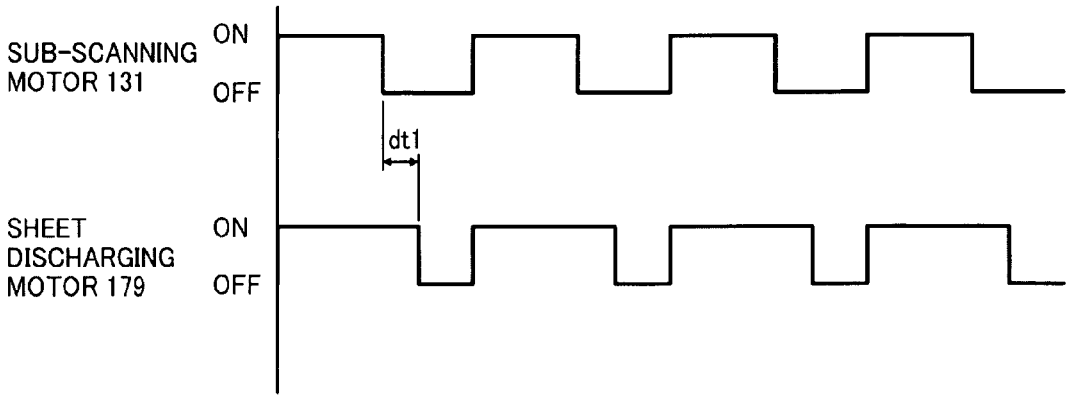
FIG. 6 is a timing chart for explaining drive control of a sub-scanning motor and a sheet discharging motor included in the image forming apparatus shown in FIG. 5.

With reference to FIG. 6, description is now made of an intermittent sheet conveying operation performed by the image forming apparatus 1 depicted in FIG. 1. FIG. 6 is a timing chart for explaining drive control of the sub-scanning motor 131 and the sheet discharging motor 179.

As illustrated in FIG. 6, in the image forming apparatus 1, the sub-scanning motor 131 is intermittently driven to cause the conveying belt 31 depicted in FIG. 1 to intermittently convey a sheet 5. Further, liquid droplets are discharged from the recording heads 24 depicted in FIG. 1 onto the conveyed sheet 5. Thereby, an image is formed on the sheet 5. Then, the sheet 5 is separated from the conveying belt 31 by the separating claw 38 depicted in FIG. 1 and conveyed to the sheet discharge device 7 depicted in FIG. 1. As illustrated in FIG. 6, the sheet discharging motor 179 of the sheet discharge device 7 is also intermittently driven in synchronization with the sub-scanning motor 131 to intermittently convey the sheet 5 to be discharged.

Herein, a drive completion timing of each drive period (e.g., each ON time) of the sheet discharging motor 179, that is, a timing of completing a time in which the sheet discharge device 7 conveys the sheet 5, is delayed by a delay time dt1 from a drive completion timing of each drive period (e.g., each ON time) of the sub-scanning motor 131, that is, a timing of completing a time in which the conveying belt 31 conveys the sheet 5. With this configuration, the sheet 5 is intermittently conveyed by the conveying belt 31 of the sub-scanning conveyance device 3, while being pulled by the sheet discharge device 7. As a result, a flatness of the sheet 5 is maintained, and a slack is prevented from occurring in the sheet 5 between the sub-scanning conveyance device 3 and the sheet discharge device 7.

Figure 7:
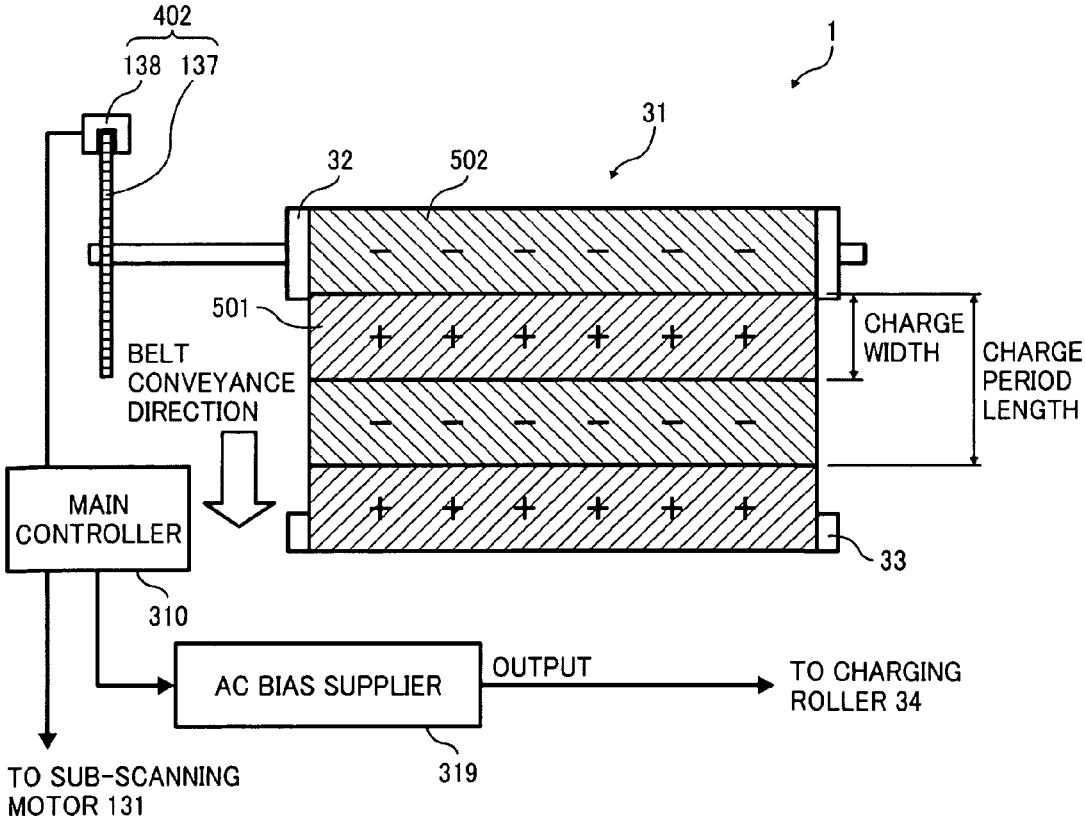
FIG. 7 is a schematic view of the image forming apparatus shown in FIG. 1 for explaining charge control of a conveying belt included in the image forming apparatus.
Figure 8:
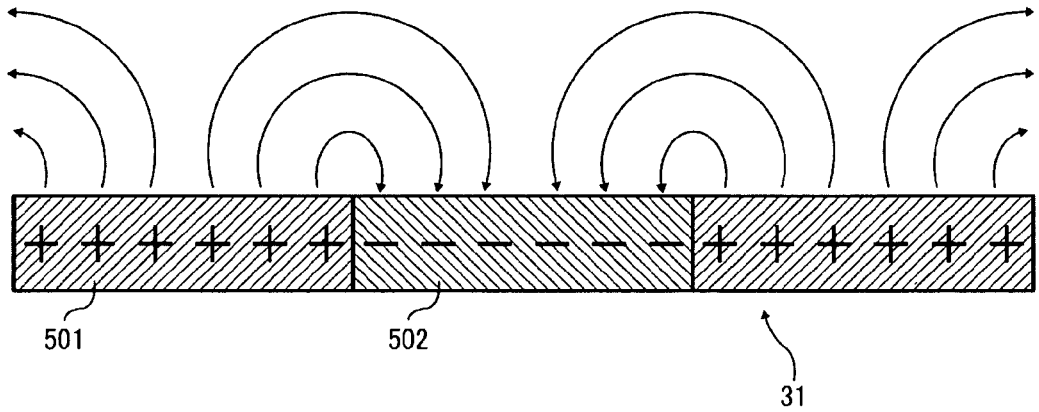
FIG. 8 is an explanatory view of the conveying belt shown in FIG. 7 for explaining charging of the conveying belt.
Figure 9:
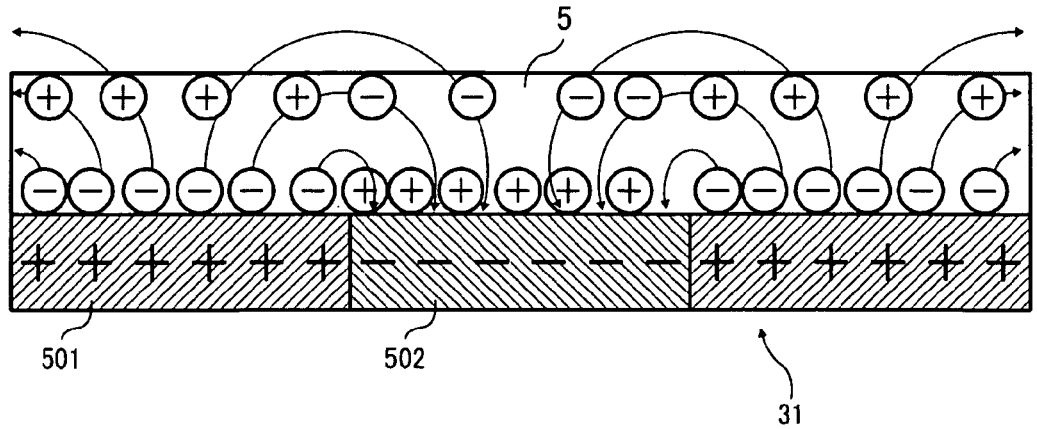
FIG. 9 is an explanatory view of the conveying belt shown in FIG. 8 for explaining contact of a sheet with the conveying belt.

With reference to FIGS. 7 to 9, an overview of charge control of the conveying belt 31 performed by the image forming apparatus 1 is now described.

With reference to FIG. 7, parts relating to charge control of the conveying belt 31 are described. As described above, a rotation amount is detected by the rotary encoder 402 which includes the encoder sensor 138 and the encoder wheel 137 provided to an end portion of the conveying roller 32 that drives the conveying belt 31. Then, based on the detected rotation amount, the sub-scanning driver 314 depicted in FIG. 5 performs drive control of the sub-scanning motor 131. Further, output from the AC bias supplier 319, which serves as a high-voltage power supply for applying a high AC bias voltage to the charging roller 34, is controlled.

The AC bias supplier 319 controls a period (e.g., an application time) of voltages of positive and negative polarities applied to the charging roller 34. Simultaneously, the main controller 310 controls drive of the conveying belt 31. Thereby, charges of positive and negative polarities can be applied onto the conveying belt 31 for a predetermined charge period length (e.g., a charge cycle). Herein, as illustrated in FIG. 7, the term "charge period length" refers to a width (e.g., a distance) in the sheet conveyance direction corresponding to one period of the applied voltages of positive and negative polarities. Further, the term "charge width" refers to a width (e.g., a distance) in the sheet conveyance direction of each of the polarities.

As described above, to start image formation, the sub-scanning motor 131 drives to rotate the conveying roller 32 to rotate the conveying belt 31 counterclockwise in FIG. 1. Simultaneously, the AC bias supplier 319 applies rectangular-wave voltages of positive and negative polarities to the charging roller 34. The charging roller 34 is in contact with an insulating layer of the conveying belt 31. As illustrated in FIG. 7, therefore, the insulating layer of the conveying belt 31 is alternately applied with a charge of positive polarity and a charge of negative polarity in the sheet conveyance direction of the conveying belt 31. That is, a band-shaped positively charged area 501 and a band-shaped negatively charged area 502 are alternately formed. As a result, a non-uniform electric field is formed on the conveying belt 31, as illustrated in FIGS. 7 and 8.

The sheet 5 is conveyed to the conveying belt 31, on which the non-uniform electric field has been generated due to the formation of the charges of positive and negative polarities on the insulating layer of the conveying belt 31. As illustrated in FIG. 9, the sheet 5 conveyed onto the non-uniform electric field on the conveying belt 31 is instantaneously polarized along a direction of the electric field. Due to the non-uniform electric field, charges appearing on a surface of the sheet 5 facing the conveying belt 31 and generating an attraction force acting between the sheet 5 and the conveying belt 31 are increased in density. Meanwhile, charges appearing on the other surface of the sheet 5 and generating a repulsive force acting between the sheet 5 and the conveying belt 31 are reduced in density. Due to the above-described difference in the charges, the sheet 5 is instantaneously attracted to the conveying belt 31. Further, the sheet 5 has a limited resistance. Therefore, simultaneously with the attraction of the sheet 5, true charges are induced on an attraction surface and the other surface of the sheet 5.

The true charges of positive and negative polarities induced on the attraction surface of the sheet 5 and the charges applied onto the conveying belt 31 attract each other. Thereby, a stable attraction force is generated. Further, the sheet 5 has a limited resistance value with a surface resistivity ranging from approximately $10^7$ ohms per square to approximately $10^{13}$ ohms per square. Thus, the true charges induced on the attraction surface and the other surface of the sheet 5 are movable. Therefore, as adjacent ones of the charges of positive and negative polarities move while attracting each other over time, the charges are neutralized and reduced in number.

As a result, the charges on the conveying belt 31 are balanced by the true charges induced on the attraction surface of the sheet 5, and the electric field disappears. Further, the true charges induced on the other surface of the sheet 5 opposite to the attraction surface are neutralized as described above, and the electric field disappears. Further, the charges applied to the surface of the conveying belt 31 and the charges on the surface of the sheet 5 generating the repulsive force acting between the sheet 5 and the conveying belt 31 are reduced in number. As a result, the attraction force of the sheet 5 to the conveying belt 31 is increased over time.

The attraction force, the charging voltage, and the charge period length are correlated. An increase in the charging voltage increases the attraction force. Further, an increase in the charge period length increases the attraction force.

As illustrated in FIG. 1, with the above-described configuration, in accordance with print data, liquid droplets are discharged from the recording heads 24 onto a sheet 5 being intermittently conveyed by the conveying belt 31, to thereby form (e.g., print) an image on the sheet 5. Then, a leading end of the sheet 5 bearing the image is separated from the conveying belt 31 by the separating claw 38 and conveyed to the sheet discharge device 7. Thereafter, the sheet 5 is appropriately discharged by the sheet discharge device 7 onto the output tray 8 or the straight output tray 181. Alternatively, the sheet 5 is conveyed by the sheet discharge device 7 to the duplex unit 10 to be formed with an image on the other side thereof, and thereafter is discharged.

Figure 10:
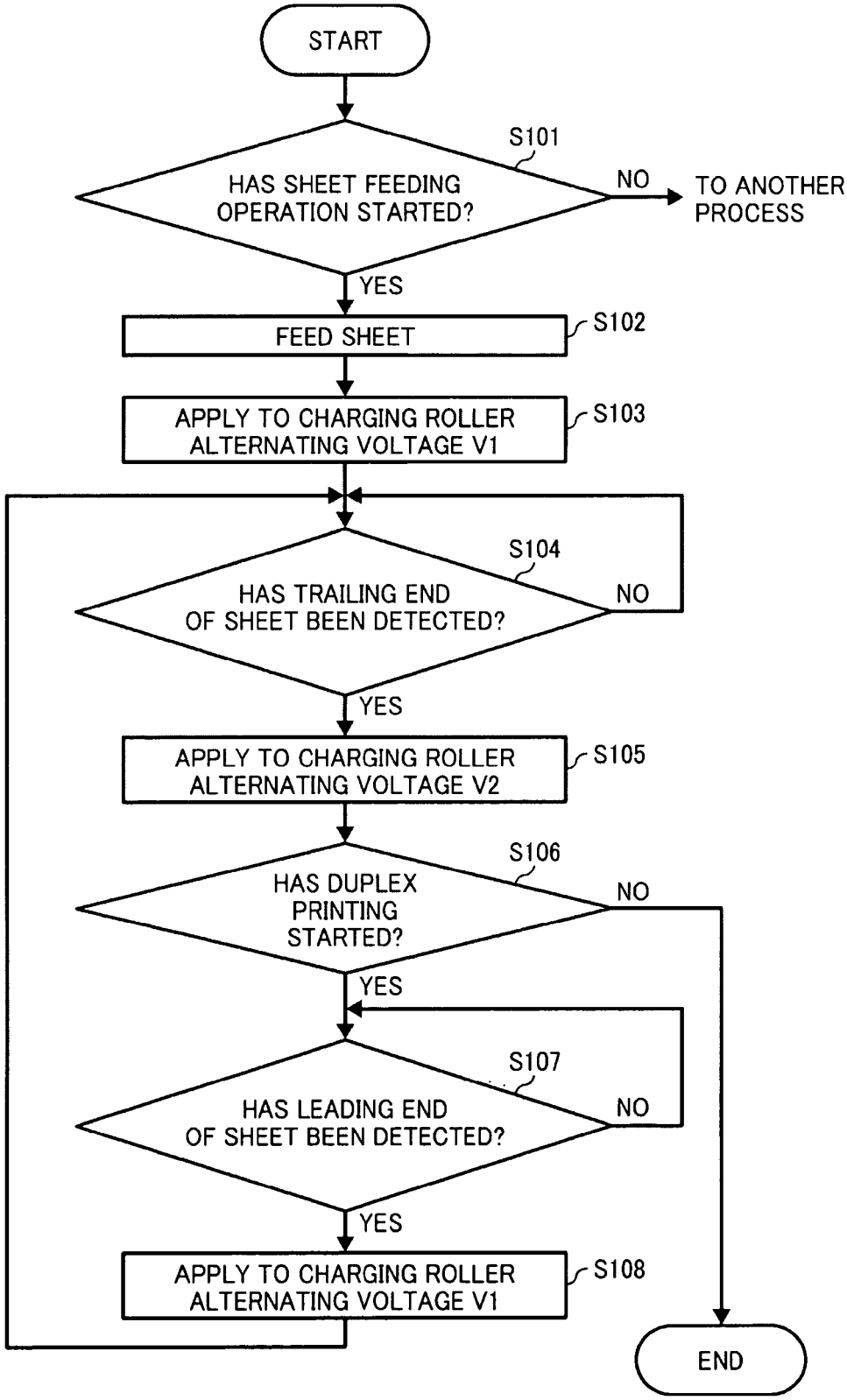
FIG. 10 is a flowchart illustrating an example of charge control of the image forming apparatus shown in FIG. 1.

With reference to a flowchart of FIG. 10, description is now made of an example of charge control performed by the main controller 310 depicted in FIG. 5. In charge control processing according to this exemplary embodiment, the controller 300 depicted in FIG. 5 determines whether or not a sheet feeding operation has started in step S101. When the sheet feeding operation has started (e.g., when YES is selected in step S101), the controller 300 starts feeding a sheet 5 for image formation in step S102. In step S103, the AC bias supplier 319 depicted in FIG. 5 applies to the charging roller 34 depicted in FIG. 5 an alternating voltage V1 predetermined such that the conveying belt 31 depicted in FIG. 1 is charged for a predetermined charge period length, e.g., approximately 12 millimeters. In step S104, the controller 300 determines whether or not the conveyance-registration sensor 201 depicted in FIG. 4 has detected a trailing end of the sheet 5. When the conveyance-registration sensor 201 has detected the trailing end of the sheet 5 (e.g., when YES is selected in step S104), that is, when the trailing end of the sheet 5 has passed a detection position of the conveyance-registration sensor 201 and the conveyance-registration sensor 201 is turned off, the alternating voltage applied by the AC bias supplier 319 to the charging roller 34 is increased to an alternating voltage V2 higher than the alternating voltage V1 in step S105.

In step S106, the controller 300 determines whether or not to perform duplex printing. In the case of duplex printing (e.g., when YES is selected in step S106), the controller 300 determines whether or not the image forming device entrance sensor 202 depicted in FIG. 4 has detected a leading end of the sheet 5 in step S107. When the image forming device entrance sensor 202 has detected the leading end of the sheet 5 (e.g., when YES is selected in step S107), the AC bias supplier 319 applies the alternating voltage V1 to the charging roller 34 in step S108.

Figure 11:
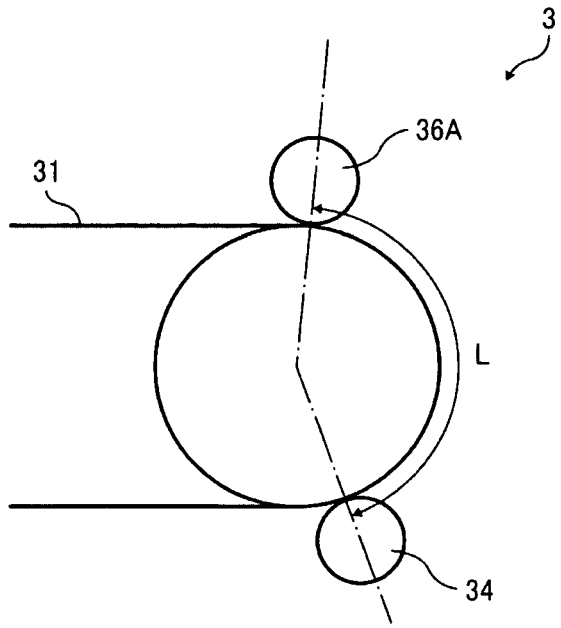
FIG. 11 is a partially sectional view of the sub-scanning conveyance device shown in FIG. 2.

As illustrated in FIG. 11, a distance L exists between the nip portion formed between the pressing roller 36A and the conveying belt 31 and a charging position of the charging roller 34 for charging the conveying belt 31. Therefore, a conveyance speed of the sheet 5, a distance between the conveyance-registration sensor 201 depicted in FIG. 4 and the nip portion, the distance L between the nip portion and the charging roller 34, and a rotation speed of the conveying belt 31 are set such that a time taken for a position on the conveying belt 31 applied with the alternating voltage V2 by the charging roller 34 to reach the nip portion does not exceed a time taken for the trailing end of the sheet 5 to reach the nip portion.

Figure 12:
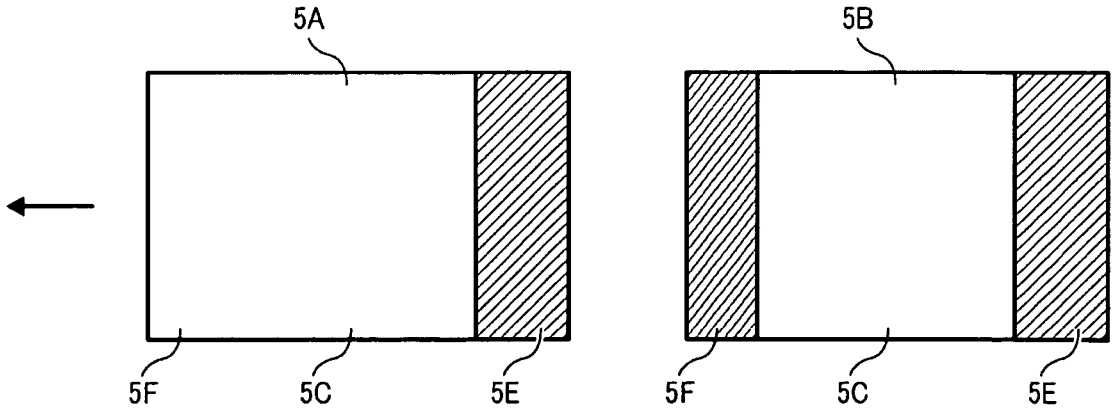
FIG. 12 is an explanatory view of a sheet and a subsequent sheet for explaining respective charged areas of the sheet and the subsequent sheet subjected to the charge control shown in FIG. 10.

With the above-described configuration, as illustrated in FIG. 12, the attraction force of the conveying belt 31 depicted in FIG. 11 is relatively high when attracting a necessary trailing end 5E indicated by hatching of a sheet 5A to be formed with an image on a first side thereof than when attracting a leading end 5F and a middle portion 5C of the sheet 5A.

As described above and illustrated in FIG. 1, the sheet 5 is intermittently conveyed by the conveying belt 31 of the sub-scanning conveyance device 3, while being pulled by the sheet discharge device 7. According to the above-described configuration, the sheet 5 is held by the conveying belt 31 with a force for properly attracting and holding the sheet 5 even in a state in which the trailing end 5E depicted in FIG. 12 of the sheet 5A has passed through the nip portion formed between the pressing roller 36A and the conveying belt 31 depicted in FIG. 11 and the sheet 5A is held solely by the attraction force of the conveying belt 31. Accordingly, a decrease in accuracy of the sheet conveyance and resultant image distortion are prevented.

Further, in the image forming apparatus 1, when the conveying belt 31 is applied with a voltage such that a charged potential of the conveying belt 31 is relatively high, and when duplex printing is performed on a predetermined sheet, e.g., the sheet 5 having a predetermined length, the distance L depicted in FIG. 11 between the nip portion formed between the pressing roller 36A and the conveying belt 31 and the charging position of the charging roller 34 for charging the conveying belt 31 is set such that a charged potential applied to the sheet 5A is relatively high in the trailing end 5E of the sheet 5A to be formed with an image on a first side thereof and in the leading end 5F of a subsequent sheet 5B to be formed with an image on a second side thereof than in the middle portion 5C of the sheets 5A and 5B, as illustrated in FIG. 12.

With the above-described configuration, even if warpage occurs in the sheet 5B in duplex printing due to drying of ink used to form an image on the first side of the sheet 5B, the attraction force of the conveying belt 31 depicted in FIG. 11 is relatively high when attracting the leading end 5F of the sheet 5B than when attracting the middle portion 5C of the sheet 5B. Accordingly, the leading end 5F of the sheet 5B can be reliably attracted and held by the conveying belt 31.

Figure 13:
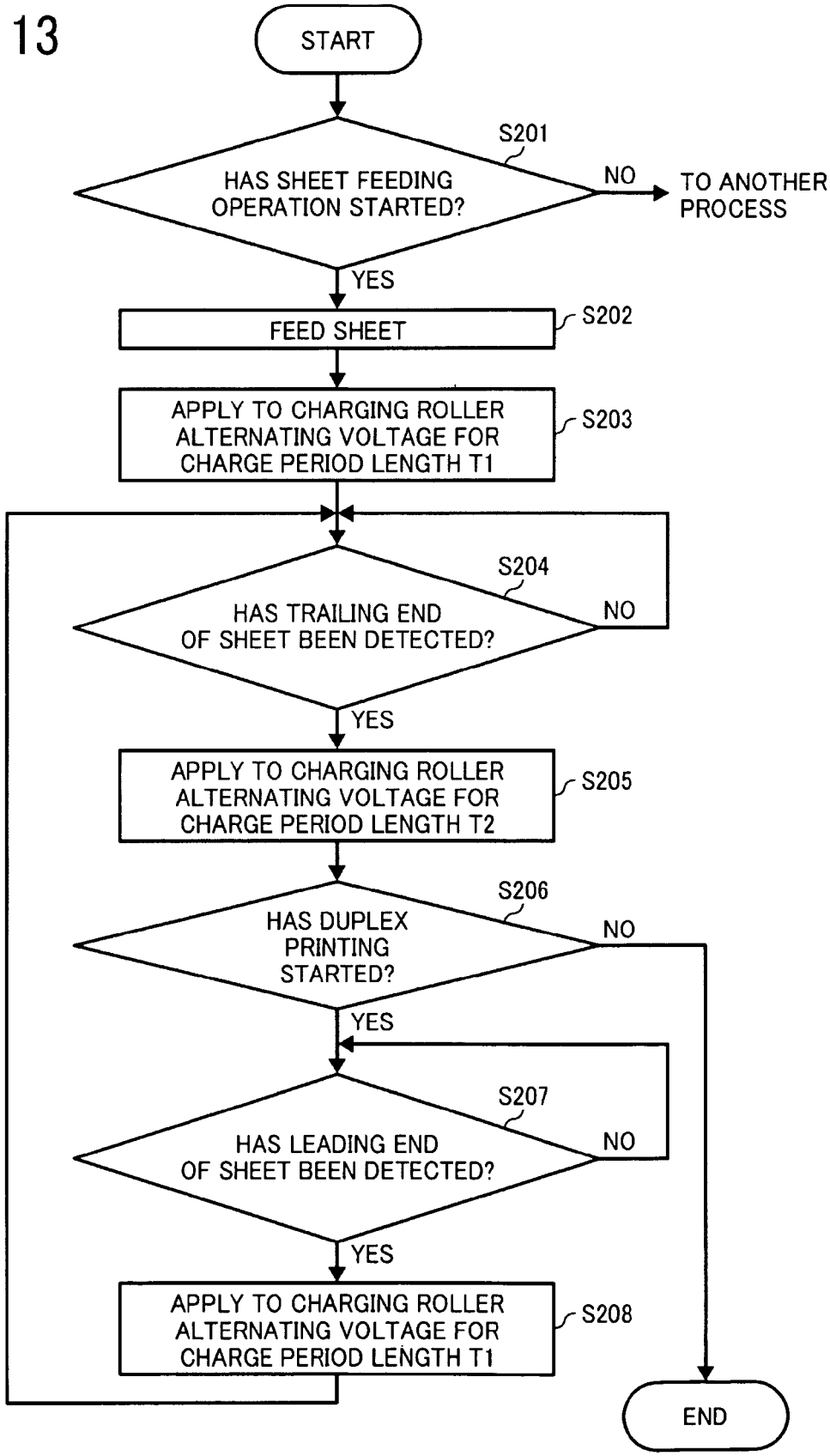
FIG. 13 is a flowchart illustrating an example of charge control of the image forming apparatus shown in FIG. 1 according to another exemplary embodiment.

With reference to FIG. 13, another exemplary embodiment is described. FIG. 13 is a flowchart illustrating an example of charge control according to this exemplary embodiment.

In charge control processing according to this exemplary embodiment, the controller 300 depicted in FIG. 5 determines whether or not a sheet feeding operation has started in step S201. When the sheet feeding operation has started (e.g., when YES is selected in step S201), the controller 300 starts feeding a sheet 5 for image formation in step S202. In step S203, the AC bias supplier 319 depicted in FIG. 5 applies to the charging roller 34 depicted in FIG. 5 an alternating voltage predetermined such that the conveying belt 31 depicted in FIG. 1 is charged for a charge period length T1, e.g., approximately 8 millimeters in step S203. In step S204, the controller 300 determines whether or not the conveyance-registration sensor 201 depicted in FIG. 4 has detected a trailing end of the sheet 5. When the conveyance-registration sensor 201 has detected the trailing end of the sheet 5 (e.g., when YES is selected in step S204), that is, when the trailing end of the sheet 5 has passed a detection position of the conveyance-registration sensor 201 and the conveyance-registration sensor 201 is turned off, the AC bias supplier 319 applies to the charging roller 34 an alternating voltage changed such that the conveying belt 31 is charged for a charge period length T2, e.g., approximately 12 millimeters, longer than the charge period length T1 in step S205.

In step S206, the controller 300 determines whether or not to perform duplex printing. In the case of duplex printing (e.g., when YES is selected in step S206), the controller 300 determines whether or not the image forming device entrance sensor 202 depicted in FIG. 4 has detected a leading end of the sheet 5 in step S207. When the image forming device entrance sensor 202 has detected the leading end of the sheet 5 (e.g., when YES is selected in step S207), the alternating voltage applied by the AC bias supplier 319 to the charging roller 34 is returned to the previous voltage such that the conveying belt 31 is charged for the charge period length T1 in step S208. In this example, the changed charge period length is returned to the previous charge period length. Alternatively, the charge period length may be fixed to the changed charge period length.

As described above, the electrostatic attraction force can also be changed by a change in the charge period length. That is, according to this exemplary embodiment, the period of the alternating voltage applied to the charging roller 34 is changed to make the electrostatic attraction force of the conveying belt 31 relatively high in the tailing end 5E depicted in FIG. 12 of the sheet 5.

Figure 14:
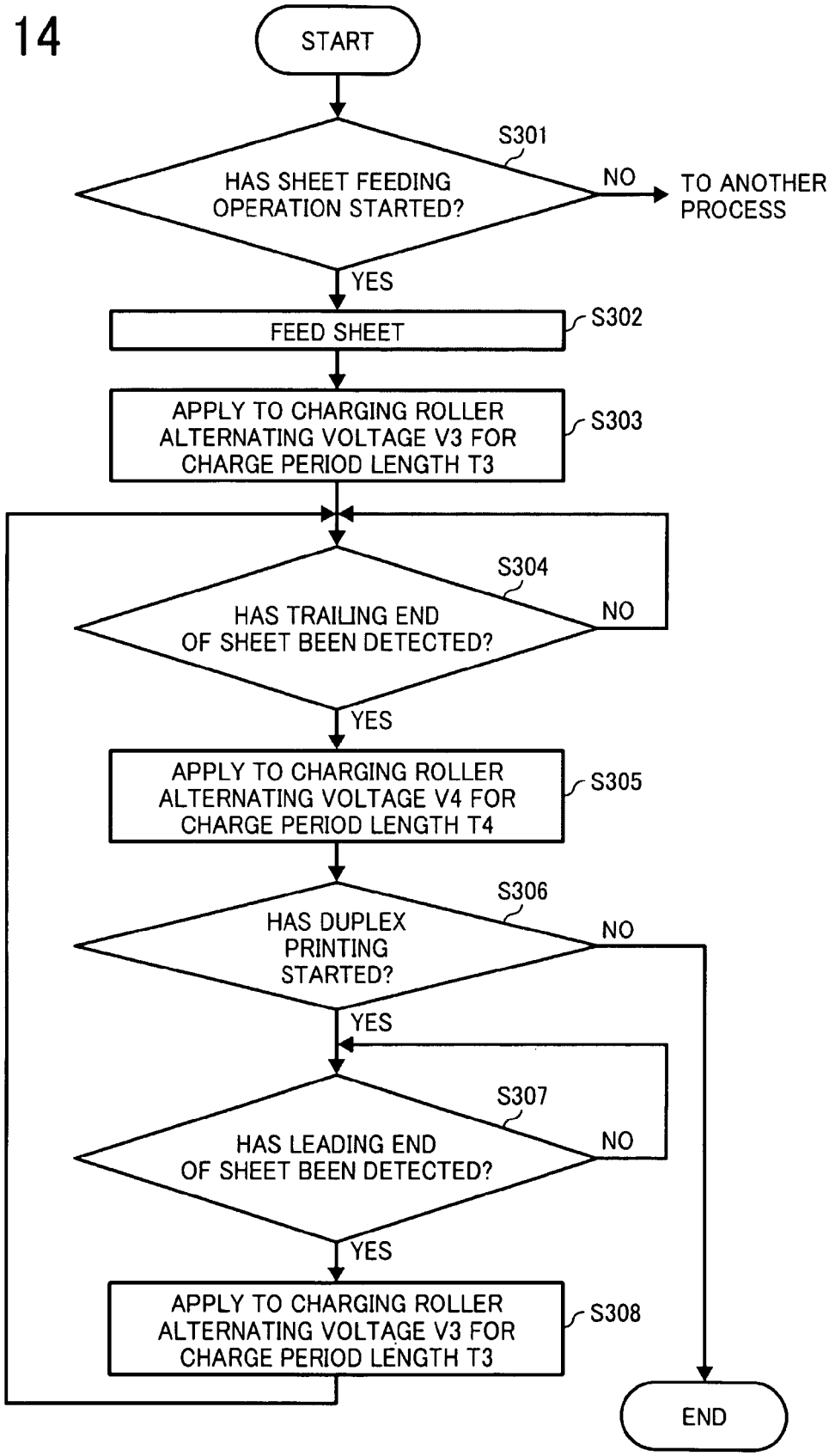
FIG. 14 is a flowchart illustrating an example of charge control of the image forming apparatus shown in FIG. 1 according to yet another exemplary embodiment.

With reference to FIG. 14, yet another exemplary embodiment is described. FIG. 14 is a flowchart illustrating an example of charge control according to this exemplary embodiment.

In charge control processing of this exemplary embodiment, the controller 300 depicted in FIG. 5 determines whether or not a sheet feeding operation has started in step S301. When the sheet feeding operation has started (e.g., when YES is selected in step S301), the controller 300 starts feeding a sheet 5 for image formation in step S302. In step S303, the AC bias supplier 319 depicted in FIG. 5 applies to the charging roller 34 depicted in FIG. 1 an alternating voltage V3 predetermined such that the conveying belt 31 is charged for a charge period length T3, e.g., approximately 8 millimeters in step S303. In step S304, the controller 300 determines whether or not the conveyance-registration sensor 201 depicted in FIG. 4 has detected a trailing end of the sheet 5. When the conveyance-registration sensor 201 has detected the trailing end of the sheet 5 (e.g., when YES is selected in step S304), that is, when the trailing end of the sheet 5 has passed a detection position of the conveyance-registration sensor 201 and the conveyance-registration sensor 201 is turned off, the alternating voltage applied by the AC bias supplier 319 to the charging roller 34 is increased to an alternating voltage V4 higher than the alternating voltage V3, and the charge period length for charging the conveying belt 31 is changed to a charge period length T4, e.g., 12 millimeters, longer than the charge period length T3, in step S305.

In step S306, the controller 300 determines whether or not to perform duplex printing. In the case of duplex printing (e.g., when YES is selected in step S306), the controller 300 determines whether or not the image forming device entrance sensor 202 depicted in FIG. 4 has detected a leading end of the sheet 5 in step S307. When the image forming device entrance sensor 202 has detected the leading end of the sheet 5 (e.g., when YES is selected in step S307), the alternating voltage applied by the AC bias supplier 319 to the charging roller 34 is returned to the previous alternating voltage V3 such that the conveying belt 31 is charged for the charge period length T3 in step S308.

As described above, the electrostatic attraction force can also be changed by a change in the charged potential and a change in the charge period length. That is, according to this exemplary embodiment, the alternating voltage applied to the charging roller 34 and the period of the applied alternating voltage are changed to make the electrostatic attraction force of the conveying belt 31 relatively high in the trailing end 5E depicted in FIG. 12 of the sheet 5. The alternating voltages V3 and V4 and the charge period lengths T3 and T4 according to this exemplary embodiment may be identical to or different from the alternating voltages V3 and V4 and the charge period lengths T3 and T4 according to the foregoing exemplary embodiments, and are not particularly limited.

Figure 15:
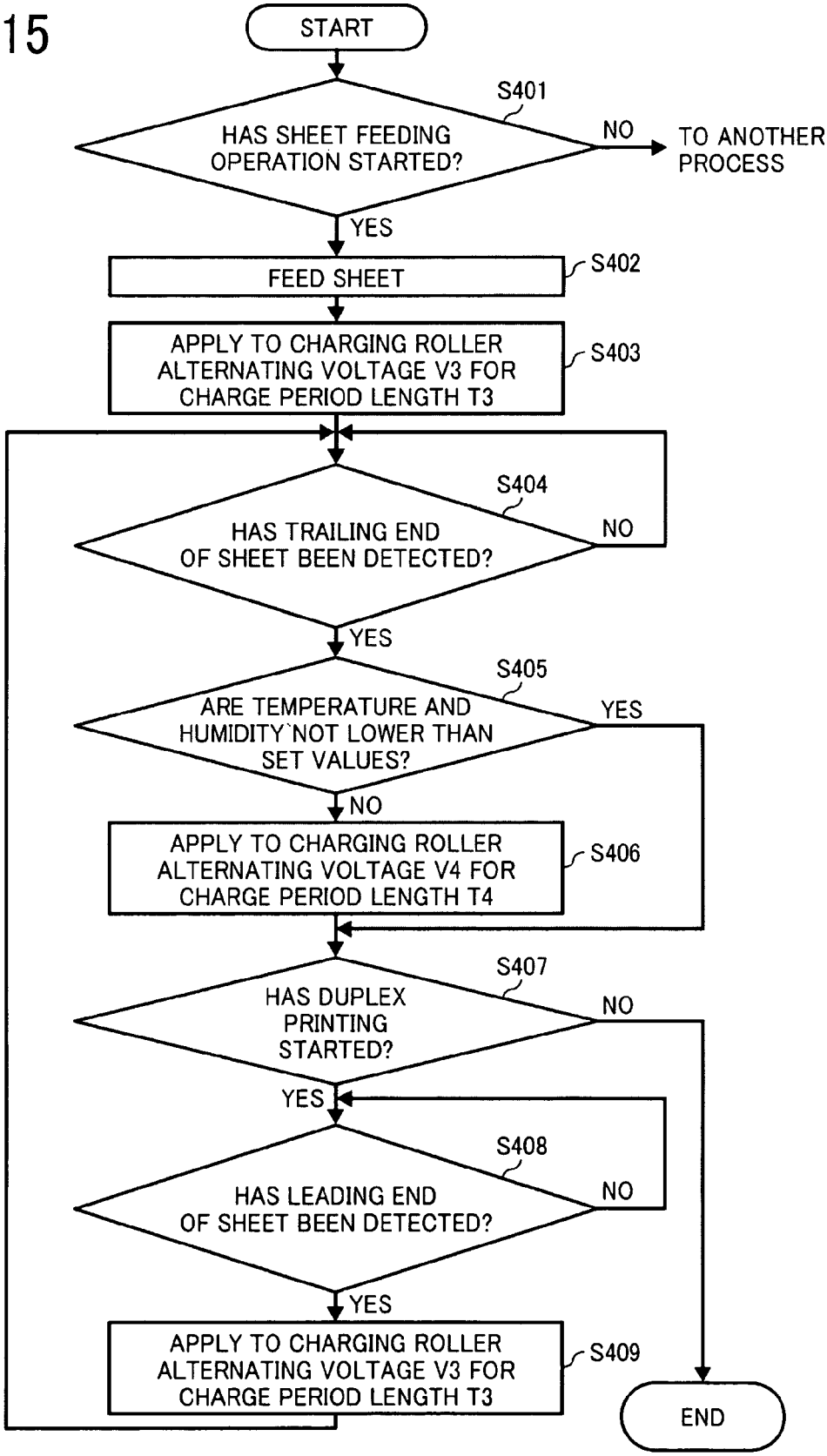
FIG. 15 is a flowchart illustrating an example of charge control of the image forming apparatus shown in FIG. 1 according to yet another exemplary embodiment.

With reference to FIG. 15, yet another exemplary embodiment is described. FIG. 15 is a flowchart illustrating an example of charge control according to this exemplary embodiment.

In charge control processing of this exemplary embodiment, the controller 300 depicted in FIG. 5 determines whether or not a sheet feeding operation has started in step S401. When the sheet feeding operation has started (e.g., when YES is selected in step S401), the controller 300 starts feeding a sheet 5 for image formation in step S402. In step S403, the AC bias supplier 319 depicted in FIG. 5 applies to the charging roller 34 depicted in FIG. 5 an alternating voltage V3 predetermined such that the conveying belt 31 is charged for a charge period length T3, e.g., approximately 8 millimeters in step S403. In step S404, the controller 300 determines whether or not the conveyance-registration sensor 201 depicted in FIG. 4 has detected a trailing end of the sheet 5. When the conveyance-registration sensor 201 has detected the trailing end of the sheet 5 (e.g., when YES is selected in step S404), that is, when the trailing end of the sheet 5 has passed a detection position of the conveyance-registration sensor 201 and the conveyance-registration sensor 201 is turned off, the controller 300 determines whether or not environmental temperature and humidity detected by the temperature-humidity sensor 234 depicted in FIG. 5 are not lower than respective predetermined set values, e.g., set temperature and humidity, in step S405. When the environmental temperature and humidity detected by the temperature-humidity sensor 234 are not lower than respective predetermined set values (e.g., when NO is selected in step S405), the alternating voltage applied by the AC bias supplier 319 to the charging roller 34 is increased to the alternating voltage V4 higher than the alternating voltage V3, and the charge period length for charging the conveying belt 31 is changed to the charge period length T4, e.g., approximately 12 millimeters, longer than the charge period length T3, in step S406. Meanwhile, if the detected environmental temperature and humidity are lower than the respective predetermined set values (e.g., when YES is selected in step S405), the applied alternating voltage and the charge period length of the applied alternating voltage are not changed.

In step S407, the controller 300 determines whether or not to perform duplex printing. In the case of duplex printing (e.g., when YES is selected in step S407), the controller 300 determines whether or not the image forming device entrance sensor 202 depicted in FIG. 4 has detected a leading end of the sheet 5 in step S408. When the image forming device entrance sensor 202 has detected the leading end of the sheet 5 (e.g., when YES is selected in step S408), the alternating voltage applied by the AC bias supplier 319 to the charging roller 34 is returned to the previous alternating voltage V3 such that the conveying belt 31 is charged for the charge period length T3 in step S409. If the applied alternating voltage and the charge period length of the applied alternating voltage have not been changed, the initial values of the voltage and the charge period length are maintained.

A reduction in the electrostatic attraction force of the conveying belt 31 is prominent in a high-temperature and high-humidity environment. To address this, the alternating voltage applied to the charging roller 34 and the period of the alternating voltage are changed in such an environment to make the electrostatic attraction force of the conveying belt 31 relatively high in the trailing end 5E depicted in FIG. 12 of the sheet 5. The alternating voltages V3 and V4 and the charge period lengths T3 and T4 according to this exemplary embodiment may be identical to or different from the alternating voltages V3 and V4 and the charge period lengths T3 and T4 according to the foregoing exemplary embodiments, and are not particularly limited. Further, according to this exemplary embodiment, the determination is made based on both the temperature and the humidity. Alternatively, the determination may be made based on either one of the temperature and the humidity.

In an image forming apparatus (e.g., the image forming apparatus 1 depicted in FIG. 1) according to the above-described exemplary embodiments, a distance between a charger (e.g., the charging roller 34 depicted in FIG. 1) and a nip portion formed between a pressing member (e.g., the pressing roller 36A depicted in FIG. 1) and a conveying belt (e.g., the conveying belt 31 depicted in FIG. 1) is adjusted to apply a voltage to the conveying belt, when duplex printing is performed on a predetermined sheet, in such a manner that a charged potential of the conveying belt is relatively high in an area electrostatically attracting a trailing end of the sheet to be formed with an image on a first side thereof and an area electrostatically attracting a leading end of a subsequent sheet to be formed with an image on a second side thereof. Accordingly, when the trailing end of the sheet has passed through the nip portion formed between the pressing member and the conveying belt, the conveying belt attracts the sheet with an increased attraction force. Further, the conveying belt attracts the leading end of the subsequent sheet with an increased attraction force for duplex printing. Accordingly, the conveying belt can attract and hold the sheet properly to feed the sheet with a constant precision and thereby prevent deterioration of image quality.

Further, in the image forming apparatus according to the above-described exemplary embodiments, the distance between the charger and the nip portion formed between the pressing member and the conveying belt is adjusted to apply an alternating voltage to the conveying belt, when duplex printing is performed on a predetermined sheet, in such a manner that a charge period length of the conveying belt is relatively great in an area electrostatically attracting a trailing end of the sheet to be formed with an image on a first side thereof and an area electrostatically attracting a leading end of a subsequent sheet to be formed with an image on a second side thereof. Accordingly, when the trailing end of the sheet has passed through the nip portion formed between the pressing member and the conveying belt, the conveying belt attracts the sheet with an increased attraction force. Further, the conveying belt attracts the leading end of the subsequent sheet with an increased attraction force for duplex printing. Accordingly, the conveying belt can attract and hold the sheet properly to feed the sheet with a constant precision and thereby prevent deterioration of image quality.

In this patent application, the term "image forming apparatus" refers to an apparatus which performs image formation by making ink land on a medium such as paper, thread, fiber, fabric, leather, metal, plastic, glass, wood, and ceramic. The term "image formation" refers not only to providing a medium with a meaningful image such as a letter and an object, but also to providing a medium with a meaningless image such as a pattern, e.g., a simple operation to make liquid droplets land on a medium. The term "ink" is not limited to what is generally called ink, but is used as a general term for all kinds of liquid usable in image formation, such as so-called recording liquid, fixing process liquid, and liquid. The "sheet" is not limited to paper in material, and refers to an object adhered with ink droplets, such as an OHP (overhead projector) transparency and cloth. Therefore, the term "sheet" is used as a general term for a recording medium, recording paper, a recording sheet, and so forth.

The above-described exemplary embodiments are illustrative and do not limit the present disclosure. Thus, numerous additional modifications and variations are possible in light of the above teachings. For example, elements and/or features of different illustrative and exemplary embodiments herein may be combined with each other and/or substituted for each other within the scope of this disclosure and appended claims. Further, features of components of the embodiments, such as the number, the position, and the shape, are not limited to the embodiments and thus may be preferably set. It is therefore to be understood that within the scope of the appended claims, the disclosure of this patent specification may be practiced otherwise than as specifically described herein.

This patent specification is based on Japanese Patent Application No. 2007-306876 filed on Nov. 28, 2007 in the Japan Patent Office, the entire contents of which are hereby incorporated herein by reference.

What is claimed is:

1. An image forming apparatus configured to perform duplex printing, said image forming apparatus comprising:

a recording head configured to discharge liquid droplets onto a sheet to form an image on the sheet;

a conveying belt configured to electrostatically attract and convey the sheet to face the recording head;

at least two rollers disposed so as to support the conveying belt;

a pressing member opposing one of the at least two rollers that is provided upstream of the recording head in a sheet conveyance direction via the conveying belt to press the sheet against the conveying belt;

a charger rotatably driven by the conveying belt to charge the conveying belt;

a sheet discharge device provided downstream from the conveying belt in the sheet conveyance direction to convey the sheet in a sheet discharging direction, the sheet discharge device being intermittently driven independently of and in synchronization with the conveying belt;

a duplex device configured to reverse and re-feed the sheet bearing the image formed on a first side thereof by the recording head to form an image on a second side of the sheet; and a voltage application device configured to apply a voltage to the charger, wherein a distance between the charger and a nip portion formed between the pressing member and the conveying belt is set and the voltage applied by the voltage application device to the charger is controlled so that for said duplex printing to a predetermined sheet and to a subsequent sheet, a magnitude of a charged potential in an area of the conveying belt electrostatically attracting a trailing end of a predetermined sheet on which an image is to be formed on a first side thereof and a leading end of a subsequent sheet on which an image is to be formed on a second side thereof is higher relative to a magnitude of a charged potential in an area of the conveying belt electrostatically attracting a portion between end portions of the predetermined sheet in the sheet conveyance direction, and wherein the image forming apparatus further comprises a controller configured to control drive of the conveying belt and control operations of the voltage application device and the charger, so that the magnitude of the charged potential of the conveying belt in the area electrostatically attracting the trailing end of the predetermined sheet and the leading end of the subsequent sheet is relatively higher than the magnitude of the charged potential in the area electrostatically attracting a leading end of the predetermined sheet.

2. The image forming apparatus of claim 1, further comprising a trailing end sensor disposed upstream of the pressing member and configured to detect a trailing end of the sheet, wherein when the trailing end sensor detects the trailing end of the predetermined sheet, voltage applied by the voltage application device to the charger is increased from a first predetermined voltage to a second predetermined voltage having a magnitude higher than that of the first predetermined voltage.

3. The image forming apparatus of claim 2, further comprising a leading end sensor configured to detect a leading end of the sheet, wherein after the trailing end sensor detects the trailing end of the predetermined sheet and when the leading end sensor detects the leading end of the subsequent sheet, the voltage applied by the voltage application device to the charger is decreased from the second predetermined voltage to the first predetermined voltage.

4. The image forming apparatus of claim 1, wherein the controller controls the drive of the conveying belt and control operations of the voltage application device and the charger, so that the magnitude of the charged potential of the conveying belt in the area electrostatically attracting the trailing end of the predetermined sheet and the leading end of the subsequent sheet is relatively higher than a magnitude of a charged potential in another area electrostatically attracting a portion between end portions of the subsequent sheet in the sheet conveyance direction.

5. An image forming apparatus configured to perform duplex printing, said image forming apparatus comprising:

a recording head configured to discharge liquid droplets onto a sheet to form an image on the sheet;

a conveying belt configured to electrostatically attract and convey the sheet to face the recording head;

a pressing member opposing a roller provided upstream of the recording head in a sheet conveyance direction via the conveying belt, to press the sheet against the conveying belt;

a sheet discharge device provided downstream from the conveying belt in the sheet conveyance direction to convey the sheet in a sheet discharging direction;

a duplex device configured to reverse and re-feed the sheet bearing the image formed on a first side thereof by the recording head to form an image on a second side of the sheet;

a charger rotatably driven by the conveying belt to charge the conveying belt; and a voltage application device configured to apply an alternating voltage to the charger, wherein a distance between the charger and a nip portion formed between the pressing member and the conveying belt is set and the voltage applied by the voltage application device to the charger is controlled so that for said duplex printing to a predetermined sheet and to a subsequent sheet, a magnitude of a charged potential and a charge cycle in an area of the conveying belt electrostatically attracting a trailing end of a predetermined sheet on which an image is to be formed on a first side thereof and a leading end of a subsequent sheet on which an image is to be formed on a second side thereof, are greater and longer, respectively, relative to those of an area of the conveying belt electrostatically attracting a portion between end portions of the predetermined sheet in the sheet conveyance direction, and wherein the image forming apparatus further comprises a controller configured to control drive of the conveying belt and control operations of the voltage application device and the charger, so that the magnitude of the charged potential of the conveying belt in the area electrostatically attracting the trailing end of the predetermined sheet and the leading end of the subsequent sheet is relatively higher than the magnitude of the charged potential in the area electrostatically attracting a leading end of the predetermined sheet.

6. The image forming apparatus of claim 5, wherein the controller controls the drive of the conveying belt and control operations of the voltage application device and the charger, so that the magnitude of the charged potential of the conveying belt in the area electrostatically attracting the trailing end of the predetermined sheet and the leading end of the subsequent sheet is relatively higher than a magnitude of a charged potential in another area electrostatically attracting a portion between end portions of the subsequent sheet in the sheet conveyance direction.

7. The image forming apparatus of claim 5, wherein the controller controls the drive of the conveying belt and control operations of the voltage application device and the charger, so that the charge cycle of the conveying belt in the area electrostatically attracting the trailing end of the predetermined sheet and the leading end of the subsequent sheet is relatively higher than a charge cycle in another area electrostatically attracting a portion between end portions of the subsequent sheet in the sheet conveyance direction.

8. The image forming apparatus of claim 5, wherein the controller controls a timing of operation of the conveying belt to convey the specific sheet to the sheet discharge device and controls a timing of operation of the sheet discharge device to pull and discharge the specific sheet conveyed by the conveying belt to the sheet discharge device, so that flatness of the specific sheet, without slack, is substantially maintained.

* * * * *